US006935332B2

(12) United States Patent
Janouch et al.

(10) Patent No.: US 6,935,332 B2
(45) Date of Patent: Aug. 30, 2005

(54) HAIR CARE APPLIANCES

(75) Inventors: Peter Janouch, Frankfurt (DE); Peter Lange, Eppstein (DE); Dieter Liebenthal, Maintal (DE); Silvia Rix, Schwalbach (DE); Heinz Kern, Königstein (DE); Peter Ruppert, Karben (DE); Friedrich Henninger, Kelkheim (DE); Jürgen Seng, Kelkheim (DE)

(73) Assignee: Braun GmbH, Kronberg (DE)

( * ) Notice: Subject to any disclaimer, the term of this patent is extended or adjusted under 35 U.S.C. 154(b) by 261 days.

(21) Appl. No.: 10/221,118

(22) PCT Filed: Mar. 9, 2001

(86) PCT No.: PCT/EP01/02676

§ 371 (c)(1),
(2), (4) Date: Sep. 9, 2002

(87) PCT Pub. No.: WO01/67916

PCT Pub. Date: Sep. 20, 2001

(65) Prior Publication Data

US 2003/0037795 A1 Feb. 27, 2003

(30) Foreign Application Priority Data

Mar. 13, 2000 (DE) ..... 100 12 192

(51) Int. Cl.[7] ..... A45D 1/04

(52) U.S. Cl. ..... 126/408; 126/409; 431/328

(58) Field of Search ..... 126/408, 409, 126/403, 406, 412, 414, 401; 431/268, 328, 329; 132/229, 232, 227, 263

(56) References Cited

U.S. PATENT DOCUMENTS 3,858,029 A * 12/1974 Walter ..... 219/222
4,248,208 A * 2/1981 Diederich ..... 126/409
4,327,752 A 5/1982 Hickel
4,374,528 A * 2/1983 Tittert ..... 132/263

FOREIGN PATENT DOCUMENTS

DE 3843186 A1 6/1990

* cited by examiner

*Primary Examiner*—Alfred Basichas
(74) *Attorney, Agent, or Firm*—Fish & Richardson P.C.

(57) ABSTRACT

Hair-care appliances such as curling tongs are provided. The hair care appliances include a heating device that is controlled in dependence on temperature by a thermostat adjacent to the heating device. The thermostat may be shielded thermally from the heating device by a partition wall.

20 Claims, 2 Drawing Sheets

HAIR CARE APPLIANCES

This application is filed under 35 USC §371 from PCT application number EP01/02676, filed Mar. 9, 2001, and claims priority under 35 USC §119 from German application number 10012192.6, filed Mar. 13, 2000.

The invention relates to a hair-care appliance, for example curling tongs.

BACKGROUND

Hair-care appliances in the form of curling tongs are known, for example, from DE-38 43 186 C2. Arranged within the tubular heating rod, laterally alongside the heating device, which comprises a tubular burner housing, is a rod-like thermostat which runs in the longitudinal direction of the heating device. The thermostat is designed as a control rod and, at one end, is connected mechanically to a valve device. The control rod controls the valve device in dependence on temperature, and the valve device, in turn, regulates the feed of gas to the heating device. The temperature of the curling tongs and/or the temperature of the heating rod is regulated in this way.

In the case of these curling tongs, the heating device emits its thermal energy in the form of heat radiation and free convection both to the tubular heating rod and directly to the thermostat. The influence of the heat of the heating device on the expansion of the control rod is thus considerably greater than the influence of the heat which flows from the heating rod to the control rod. On account of this arrangement, the controller obtains the largest percentage of its temperature information from the heating device, which may be configured as an open flame or as a catalyst. Accordingly, the heat acting directly on the control rod from the heating device may result in the control rod being regulated down all too prematurely, with the result that the heating rod does not heat up quickly enough. Following this regulating-down operation, the dwell time until the valve device is regulated up is then comparatively long because the cooling of the control rod, and thus the opening of the valve device, takes up a certain period of time in which rapid heating of the heating rod is diminished.

It is also found that the temperature of the heating rod during operation is not always the optimum temperature for sufficient curl shaping, i.e. the temperature of the heating rod may be too high or else also too low, because the system is self-limiting during reheating and thus only regulates the temperature of the heating rod moderately well.

SUMMARY

The invention features hair-care appliances, for example curling tongs, in which the temperature of the heating rod can be better detected and the heating rod can thus be heated up more quickly. During operation, in preferred hair-care appliances the heating rod maintains a substantially uniform temperature without undesired temperature peaks occurring either upward or downward.

In one aspect of the invention, the hair-care appliance includes a heating device, and a thermostat that is shielded thermally from the heating device by a partition wall. With the temperature shielding of the thermostat by a partition wall, most of the thermal energy of the heating device, which is preferably in the form of heat radiation and free convection, passes both into the heating rod and into the partition wall, but no longer directly into the thermostat. This thermal energy introduced is then distributed uniformly, by means of heat conduction, both into the heating rod and into the partition wall. It is only then that, from there, some of the thermal energy passes into the thermostat, which, for its part, heats up correspondingly. During cooling of the heating device, the heating rod and the partition wall and, in dependence on the two last-mentioned parts, also the thermostat cools.

The thermostat thus obtains its temperature to the greatest extent from the temperature of the partition wall and the heating rod. The thermostat regulates the flow of gas up and down in dependence on the temperature of the heating rod, this preferably being the case when a state of thermal equilibrium has been established between the temperature of the heating rod, the partition wall and the temperature of the thermostat. As a result, this system reacts more quickly to changes in the temperature at the heating rod and no longer predominantly to changes in the temperature at the heating device. The thermostat accordingly obtains its data rather more from the temperature of the heating rod and the partition wall than from the temperature of the heating device. The temperature of the heating rod can be regulated more precisely as a result.

A further advantage is that upon cold adjustment of the thermostat, following the production and assembly of the hair-care appliance, the setting of a large number of series-production appliances is approximated or simplified, i.e. virtually no more cold adjustment is necessary or it can be carried out considerably more quickly on the appliances produced since the tolerances which inevitably result during production and assembly and the temperature peaks, which generally are now less frequent and/or less high, have a considerably lesser effect on the regulating behavior of the hair-care appliance.

In some implementations, when the hair-care appliance is heated up, the heating device is only regulated down when the heating rod has virtually reached its optimum hair-treating temperature. In addition, during operation of the hair-care appliance, the valve device, which serves for controlling the heating device, is regulated up and down very precisely and quickly by the thermostat, with the result that the temperature of the heating rod is only exposed to very low temperature fluctuations. This results, on the one hand, in it not being possible, as a result of absent temperature peaks, for hair to be subjected to undue stress, but, on the other hand, in the optimum temperature for quick hair shaping always being maintained to the greatest extent.

In some implementations, the partition wall may be thermally connected to the heating rod. In this case, in addition to the heat radiation and free convection, the heat conduction also acts on the partition wall in order for the temperature of the partition wall to be brought into line to the greatest extent with the temperature of the heating rod, account also being taken here of the fact that the wall of the heating device is closer to the partition wall than the entire inner surface of the heating rod. In order nevertheless to reduce these differences in temperature between the heating rod and the partition wall, it may be advantageous for ribs to be provided on the inner surface of the heating rod, said ribs being closer to the heating device and thus, in accordance with the formation of the partition wall, also being able to absorb more heat. As a result, the heating rod is heated more uniformly all the way round and its temperature thus essentially coincides with the temperature at the partition wall.

In some cases, the partition wall and the thermostat may run essentially parallel to the tubular heating rod, with the result that the entire length of the heating rod is temperaturemonitored and temperature-regulated. This achieves a more uniform temperature for the entire length of the heating rod. In this case, the thermostat preferably comprises a cross-sectionally round control rod, which runs at a distance from, and essentially parallel and, for instance, with correspondingly equal length to, the heating device. Such control rods are used in the type GCC 50 cordless curling tongs which have been commercially available from the applicant for some time now (see Braun's product range overview "Qualität in guter Form" [Quality in Good Shape], 1999/2000 issue, page 9), so that no further details need be given here. This also applies to the construction of the curling tongs overall, such as the valve device, the catalyst, the heating rod, etc., so that, for an explanation of the curling tongs claimed here, reference can be made to this appliance and/or the latter can also form part of the contents of this application.

The partition wall may be of essentially annular design in cross-section, and may be connected integrally to the heating rod via a crosspiece. These features allow straightforward production and attachment of the partition wall to the heating rod. In this case, it is possible for the crosspiece to be advantageously welded to the inner wall of the heating rod or connected integrally thereto. The metallic connection of the crosspiece to the heating rod constitutes a good thermal connection between the partition wall and the heating rod, with the result that it is also the case that the partition wall has virtually the same temperature as the heating rod itself.

If desired, the partition wall may have one or more through-passages within the heating rod. Thus, the influence of the heating device on the thermostat may be somewhat increased, with the result that the thermostat reacts somewhat more quickly to the temperature of the heating device. The regulating behavior of the thermostat can be influenced to a considerable extent by the number or width of the through-passage or through-passages, by the wall thickness of the partition wall, by the arrangement of the control rod in the heating tube in relation to the heating device, by the design of the heating rod itself and by the heating output of the heating device per unit of time. In dependence on these variables, the best possible regulating behavior can be determined in tests in order always to obtain an optimum temperature, which is neither too high nor too low, on the outer surface of the heating rod.

In some implementations, the through-passage discussed above may be designed as a longitudinal slot, and the thermostat may be designed as a control rod. For example, the through-passage may be formed by just one longitudinal slot, which is dimensioned with such a width that the control rod is already at least in partial view. Thus, as a result of the heat radiation acting on it, the control rod can react more quickly to temperature peaks of the heating device both in the upward and in the downward direction. By virtue of the longitudinal slot formed in the partition wall, it is also possible, as a result of heat radiation, for heat to flow comparatively quickly into the space enclosed by the partition wall in order, in particular during the heating-up operation, to allow quicker heating of the partition wall and thus more precise regulation of the thermostat.

In some implementations, one end of the partition wall may be connected integrally to the heating rod, while the other, free end terminates at a distance in front of the inner wall of the heating rod in order to form the longitudinal slot discussed above. Thus, the thermal connection between the partition wall and the heating rod may be reduced, while the thermal influence of the heating device is increased. This improves the regulating behavior of the thermostat.

The chamber which closes off the partition wall and in which the control rod runs may have a direct connection to the chamber enclosing the catalyst. This direct connection may produce a good thermal connection, in particular when the longitudinal slot discussed above runs over the entire length of the thermostat.

The heating rod and the partition wall may form a single shaped part. This can result in a tubular heating rod which can be produced particularly straightforwardly as a shaped part, because it does not have to be assembled from a number of parts. It may be particularly advantageous if the shaped part is an extruded part which is produced by extrusion of a material which is supplied by the meter, preferably aluminum or some other material which is a good heat conductor and flows freely for extrusion purposes.

DESCRIPTION OF DRAWINGS

An exemplary embodiment of the invention is described in more detail hereinbelow and is illustrated in the drawing in which.

DETAILED DESCRIPTION

Figure 1:
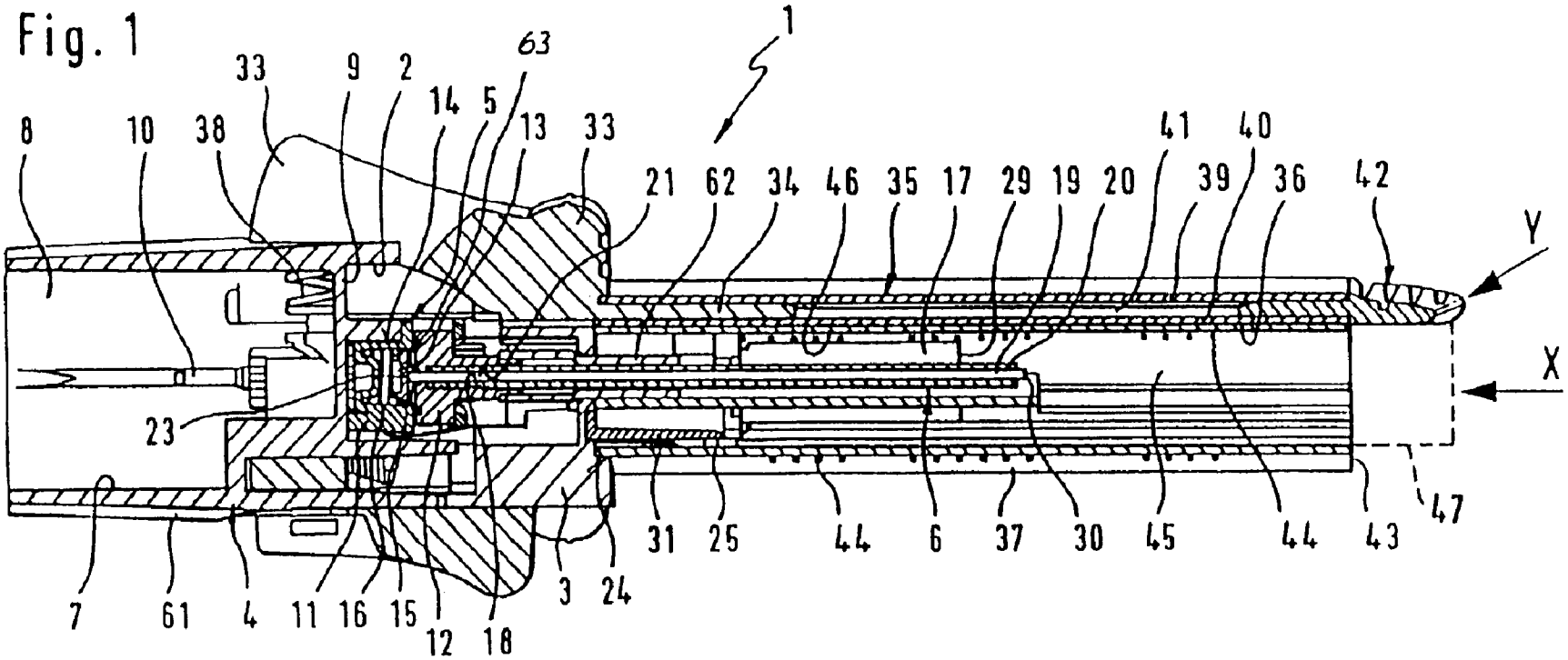
FIG. 1 shows a longitudinal section through curling tongs in the region of the thermostat, designed as a control rod, with its valve device formed at one end, the free end of the heating rod being covered for better demonstration purposes—not in the usual manner—by a closure device.
Figure 2:
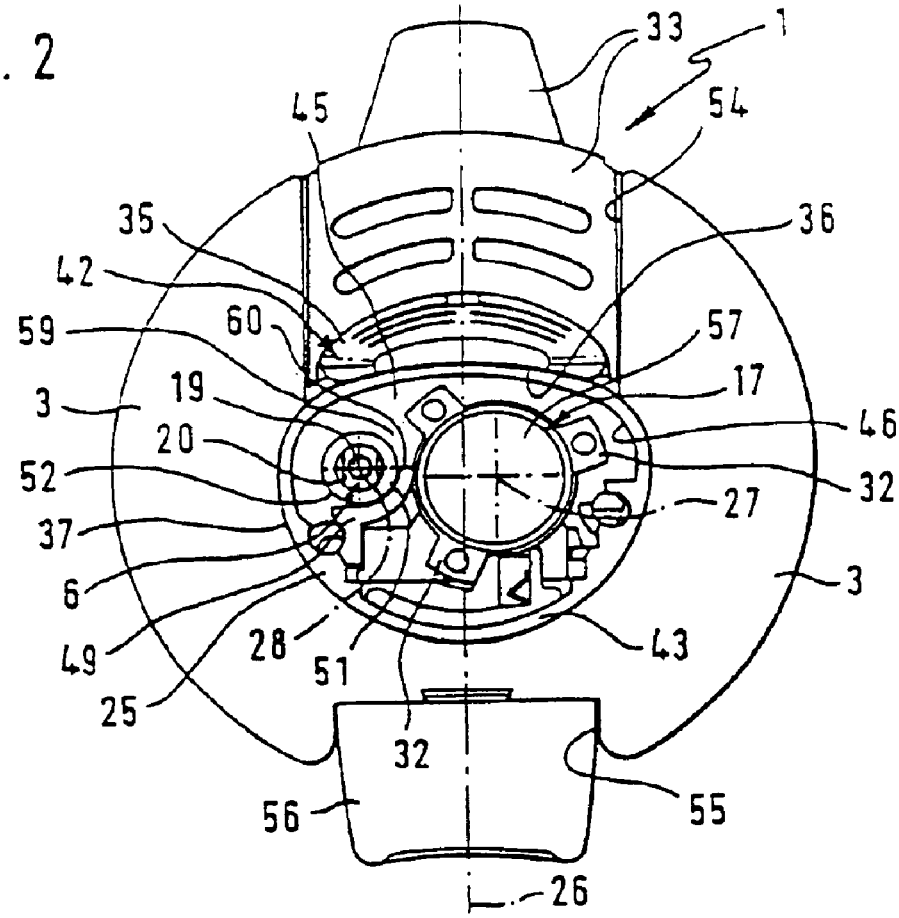
FIG. 2 shows an enlarged plan view, in direction X, of the free end of the heating rod according to FIG. 1.
Figure 3:
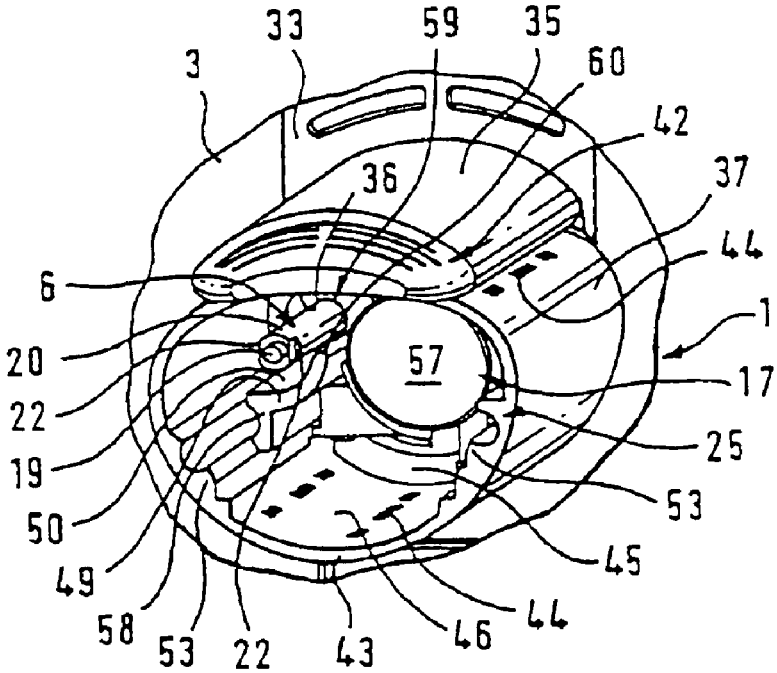
FIG. 3 shows a perspective illustration in direction Y according to FIG. 1, although the handle region has been broken away and the illustration is likewise on a larger scale than FIG. 1.

In FIGS. 1 to 3, the curling tongs 1 comprise an essentially cup-like mount 4 which has an essentially annular housing 3 inserted into its bore 2, which is accessible from the right-hand side according to FIG. 1, and centered there, said housing serving for accommodating a valve device 5, which is fastened in the housing 3, and a thermostat 6, which is designed as a control rod. The mount 4 is open from the left-hand side according to FIG. 1 and is formed by a blind bore 7 into which a gas cartridge (not illustrated in the drawing) can be inserted. Projecting through the space 8 of the blind bore 7 is a gas tube 10, which penetrates the base 9 and, when a gas cartridge is inserted, actuates the valve arrangement formed in the gas cartridge (this valve arrangement not being illustrated) and thus produces a gas connection from the gas cartridge to the valve device 5 of the curling tongs 1.

According to FIG. 1, the valve device 5 comprises a base-side installation plate 11, which is screwed to a controller mount 12, or fastened thereon in some other manner, from the right-hand side. A seal 13 is clamped in between the two parts 11, 12 in order for the valve chamber 13, which is formed by the installation plate 11 and the controller mount 12, to be sealed in the outward direction. The valve device 5 is centered in an accommodating bore 14 formed in the mount 4. Located in the valve chamber 13 is a valve piston 15, which can be displaced to the left counter to the force of a compression spring 16 and thus opens the valve device 5 in order that gas can be fed to the catalyst 17, via channels which are not illustrated in the drawing, for combustion purposes.

According to FIG. 1, a threaded bore 18 is formed in the controller mount 12, and a tube 20, which encloses a Vacodil rod 19, is firmly screwed in said threaded bore by means of a thread 21. The Vacodil rod 19 preferably consists of an iron/nickel alloy and is subjected to a low and constant level of deformation in the event of temperature increase. In contrast, the tube 20 consists of a metal which undergoes a high level of deformation under the action of temperature. Since the free end of the tube 20 and the free end of the Vacodil rod 19 are forced together, as the flattened sections 22 in FIG. 3 show, the tube 20 extends, in the event of an increase in temperature of the control rod 6, and in the process carries along with it the Vacodil rod 19, the length of which deforms to a lesser extent. As a result, the end 23 of the Vacodil rod 19, said end butting against the valve piston 15, moves to the right according to FIG. 1. Since the compression spring 16 always holds the valve piston 15 in the drawing in abutment against the free end 23 of the Vacodil rod 19, the valve piston 15 also moves to the right according to FIG. 1 and closes the gas line (not illustrated) in the direction of the catalyst 17, with the result that the latter emits less heat.

According to FIG. 1, the heating rod 25, which comprises a tubular shaped part, is supported on the housing 3, in a housing bore 24, and extends from there to the right according to FIG. 1. The heating rod 25 is produced as an extruded part in an extruder and thus, in cross section, has a cross-sectional shape which is adapted to the conditions of the curling tongs 1 and has different wall thicknesses, as FIGS. 2 and 3 show. As can also be seen from FIGS. 2 and 3, the control rod 6 is arranged on the left alongside a heating device 17, designed as a catalyst, and runs essentially parallel to the longitudinal axis 26 of the heating rod 25. The cross-sectional profile of the heating rod 25 runs symmetrically in relation to the longitudinal axis 26. According to FIGS. 2 and 3, the center point 27 (FIG. 2) of the catalyst 17 is located to the right of the longitudinal axis 26, while the center point 28 of the control rod 6 is formed to the left of the longitudinal axis 26 in the heating rod 25. As can also be seen from FIG. 1, the control rod 6 runs approximately over half the length of the heating rod 25, while the free end 29 of the catalyst 17 terminates a few millimeters in front of the free end 30 of the control rod 6. The catalyst 17 is retained in a carrier 31, which is firmly connected to the housing 3 via fastening rods 32 formed on it (FIG. 2).

Fastened rotatably on the top side of the housing 3, according to FIGS. 1 to 3, is a button 33 which, via its extension 34, engages in a double-walled clamp 35 and thus firmly connects the latter to the button 33. The inner surface 36 of the clamp 35 butts against the top side of the outer surface 37 of the heating rod 25 when the button 33 is not actuated. This is achieved by a spring 38 (FIG. 1) which acts on the button 33 and is supported on the mount 4. At the free end of the clamp 35, an end cap 42 engages in the gap 41 formed by the two walls 39, 40, said end cap serving as a handle for the curling tongs 1 and as a means of protecting a user against burning. The end cap 42 is firmly connected to the clamp 35, for example, by crimping, adhesive bonding, a screw connection or some other fastening method. The handle 61 of the curling tongs 1 forms the outer surface of the mount 4.

According to FIGS. 1 to 3, the heating rod 25 has openings 44, via which the heat emitted by the catalyst 17 during operation can escape. In order to give a view into the interior 45 of the heating rod 25 from the free end 43, the closure cap 47, which would otherwise be inserted into the inner wall 46 of the appliance in its complete state, has been omitted and is only illustrated by dashed lines.

According to FIGS. 2 and 3, a partition wall 49 extends from the inner wall 46 of the heating rod 25 into the interior 45, said partition wall only partially enclosing the control rod 6 and running over a circular-ring arc which corresponds approximately to the length of a quarter-circle. In this way, only approximately half the surface of the control rod 6 is exposed to the direct heat radiation of the catalyst 17, while the other half is covered by the partition wall 49. The wall surface 50, which is directed toward the control rod 6, runs at a predetermined distance from, and concentrically in relation to, the control rod 6, this resulting in the formation, between the two parts, of an intermediate gap 51 in the form of an annular segment, although it is also possible for this gap to assume some other form.

According to FIG. 2, the line 52, which runs concentrically in relation to the control rod 6, constitutes a bore in the housing 3 via which the control rod 6 penetrates through a sleeve 62 and passes to the valve device 5. The partition wall 49 is connected integrally to the heating rod 25. Furthermore, corresponding profiles 53 are integrally formed on the inner wall 48, these profiles serving for centering, accommodating and adapting the components formed in the interior 45 of the heating rod 25, as has already been mentioned above.

According to FIG. 2, the housing 3 has diametrically opposite recesses 54, 55, the button 33 being embedded in the recess 54 and an ignition slide 56 being embedded in the recess 55, said ignition slide being connected, via lever mechanisms which are not illustrated in the drawing, to an ignition device, which is not illustrated in the drawing either.

According to FIGS. 2 and 3, the partition wall 49 is connected to the inner wall 46 of the heating rod 25 via a crosspiece 58, with the result that the heat is thereby introduced from the heating rod (heat conduction). The free end 60 of the partition wall 49 terminates at a distance in front of the inner wall 46 of the heating rod 25 located opposite it and thus forms a longitudinal slot 59.

Referring to FIGS. 1, 2 and 3, the curling tongs 1 function as follows:

First of all, the valve device 5 is actuated, via a valve slide which is not illustrated in the drawing, such that gas flows into the catalyst 17 via the gas cartridge, the gas tube 10 and the valve device 5. It should be mentioned here that, in the cold state, the control rod 6 always keeps the valve piston 15 in its open position, but that this position can always be moved into the closed position by a main slide (not illustrated) if the appliance is no longer to be used. The ignition slide is then actuated and, via an ignition mechanism which is not illustrated in the drawing, one or more sparks are produced in the catalyst 17, these sparks causing the air/gas mixture which is located in the interior 57 of the catalyst 17 to explode. The explosion is followed by the commencement of the catalytic combustion at the catalyst 17. The catalyst 17 is heated and the heat emitted by it radiates into the interior 45 of the heating rod 25.

Some of the heat irradiates the surface of the control rod 6 directly, while some more of the heat is shielded by the partition wall 49. The convection and heat radiation emanating from the heating rod 25, the partition wall 49 and the catalyst 17 heats the control rod 6 until such time as, just before the desired temperature of the heating rod is reached, it slowly actuates the valve device 5 and thus restricts the feed of gas to the catalyst 17. This takes place because, when the control rod 6 is heated, the tube 20 expands to a considerably greater extent than the Vacodil rod 19, i.e. the free end 23 of the Vacodil rod 19 is moved to the right according to FIG. 1. As a result of the force of the compression spring 16, the valve piston 15 follows this movement, since it is always held in abutment against the Vacodil rod 19. This results in the feed of gas to the catalyst 17 being regulated down.

As a result of the reduction in the catalytic combustion, the catalyst 17 cools and less heat is introduced into the heating rod 25. It is likewise the case that the level of heat radiation to which the control rod 6 is subjected by the catalyst 17 is lower, with the result that said control rod also cools. At the same time, the heat which is emitted by the heating rod 25 and by the partition wall 49, and was introduced via the catalyst 17 on account of heat radiation and heat conduction, has a lesser cooling effect on the control rod 6, with the result that, overall, only a slight reduction in the feed of gas is introduced.

If, then, curls are wound around the outer surface 37 of the heating rod 25 at the operating temperature of the latter, although in this case it is necessary for the clamp 35 to be pivoted open in the upward direction by virtue of the button 33 being actuated, heat is emitted to the hair (not illustrated) by the heating rod 25. At the same time, hot air flows on account of the combustion gases produced during the catalytic combustion, this hot air penetrating outward, likewise into the hair, via the openings 44. This heats the hair, while the heating rod 25 cools at the same time.

Less heat then radiates from the heating rod 25 to the control rod 6, with the result that, although more heat is now radiated from the catalyst 17 from the other side, said control rod cools overall and, in the process, the length of the tube 20 shortens again. As a result, the free end 23 of the Vacodil rod 19 is displaced to the left according to FIG. 1. In this case, the valve piston 15 is also displaced to the left, counter to the force of the compression spring 16, and the channels, which are not illustrated in the drawing, is opened, with the result that more gas can flow into the catalyst 17 again. The catalytic combustion in the catalyst 17 increases and more heat is introduced into the interior 45 again.

The control rod 6 is influenced to a considerably greater extent by the temperature of the heating rod 25 than by the temperature of the catalyst 17, which results in it being possible to avoid temperature peaks and thus in the temperature behavior of the curling tongs 1 as a whole being improved. The dimensions of the partition wall 49 may be made to correspond to the dimensions of the control rod 6, of the heating rod 25, of the catalyst 17 and of the other components which are to be heated in the curling tongs 1, such that in the event of a nevertheless quick heating-up operation, when the desired temperature of the heating rod 25 is reached, the control rod 6 reacts to the temperature quickly enough for the desired temperature of the heating rod to be maintained to the greatest extent. In this case, it is also possible for the partition wall 49 to be attached to the inner wall 48 of the heating rod 25 to a greater or lesser extent via a larger or smaller surface area in order for more or less heat to be introduced into the partition wall 49, in order that the latter can emit more or less heat to the control rod 6 and the desired temperature of the heating rod thus remains, to the greatest extent, constant. Of course, the distances of the control rod 6 from the inner wall 48 of the heating rod 25, from the inner wall 50 of the partition wall 49 and from the outer wall of the catalyst 17 are also of critical importance for the purpose of achieving optimum regulating behavior for the curling tongs 1. These distances, and these dimensions of the components in relation to one another, can only be determined by tests.

What is claimed is:

1. A hair-care appliance comprising:

a heating rod around which hair can be wound, a heating device disposed within the heating rod, a thermostat configured to sense the temperature of the heating rod and regulate the heating device based on the sensed temperature, and a partition wall configured to shield the thermostat thermally from the heating device.

2. The hair-care appliance of claim 1 wherein the thermostat is configured to regulate flow of fuel to the heating device.

3. The hair-care appliance of claim 2 further comprising a valve device, controlled by the thermostat, configured to meter the flow of fuel to the heating device.

4. The hair-care appliance of claim 1, wherein the partition wall is thermally connected to the heating rod.

5. The hair-care appliance of claim 4, wherein the heating device, the thermostat and the partition wall extend in the longitudinal direction of the heating rod.

6. The hair-care appliance of claim 5 wherein the heating device, the thermostat and the partition wall extend substantially parallel to the heating rod.

7. The hair-care appliance of claim 1, wherein the partition wall is of essentially annular design in cross-section.

8. The hair-care appliance of claim 7 wherein the partition wall is connected integrally to the heating rod via a cross-piece.

9. The hair-care appliance of claim 1, wherein the partition wall defines at least one through-passage.

10. The hair-care appliance of claim 9, wherein the through-passage comprises a longitudinal slot.

11. The hair-care appliance of claim 10 wherein the thermostat comprises a control rod.

12. The hair-care appliance of claim 1 wherein the thermostat comprises a control rod.

13. The hair-care appliance of claim 10, wherein a first end of the partition wall is connected integrally to the heating rod, while a second, free end of the partition wall terminates at a distance in front of an inner wall of the heating rod, thereby defining the longitudinal slot.

14. The hair-care appliance of claim 11, wherein the longitudinal slot extends the entire length of the control rod.

15. The hair-care appliance of claim 1, wherein the heating rod and the partition wall comprise a unitary part.

16. The hair-care appliance of claim 15, wherein the unitary part is an extruded part.

17. The hair-care appliance of claim 16 wherein the extruded part comprises drawn aluminum.

18. A hair-care appliance comprising:

a heating rod around which hair can be wound, a heating device disposed within the heating rod, a thermostat configured to sense the temperature of the heating rod and regulate the heating device based on the sensed temperature, and a partition wall configured to shield the thermostat thermally from the heating device, wherein the partition wall extends substantially parallel to the heating rod.

19. The hair-care appliance of claim 18 wherein the heating device and the thermostat extend substantially parallel to the heating rod.

20. A hair-care appliance comprising:

a heating rod around which hair can be wound, a heating device disposed within the heating rod, a thermostat configured to sense the temperature of the heating rod and regulate the heating device based on the sensed temperature, and a partition wall, disposed between the heating rod and heating device and configured to shield the thermostat thermally from the heating device.

* * * * *